US007243466B2

(12) United States Patent
Bloch-Fortea

(10) Patent No.: US 7,243,466 B2
(45) Date of Patent: Jul. 17, 2007

(54) ANTI-SEISMIC SYSTEM

(76) Inventor: Jean-Claude Bloch-Fortea, Carrer Prat Salit 24 5° 4a, Santa Coloma, Principat d'Andorra (FR)

( * ) Notice: Subject to any disclaimer, the term of this patent is extended or adjusted under 35 U.S.C. 154(b) by 677 days.

(21) Appl. No.: 09/861,632

(22) Filed: Oct. 28, 2003

(65) Prior Publication Data

US 2005/0086877 A1 Apr. 28, 2005

(51) Int. Cl.
*E04B 1/98* (2006.01)

(52) U.S. Cl. ..... 52/167.1; 52/167.8; 52/167.6; 52/167.4

(58) Field of Classification Search .... 52/167.1–167.9; 248/636, 638, 565
See application file for complete search history.

(56) References Cited

U.S. PATENT DOCUMENTS 3,748,800 A * 7/1973 Glicksberg ..... 52/167.4
4,554,767 A * 11/1985 Ikonomou ..... 52/167.9
6,224,743 B1 * 5/2001 Satyanarayana ..... 205/740
6,790,294 B1 * 9/2004 Ishida et al. ..... 148/212

* cited by examiner

*Primary Examiner*—Cari D. Friedman
*Assistant Examiner*—Jonathan Junker
(74) *Attorney, Agent, or Firm*—Brown & Michaels, PC

(57) ABSTRACT

The present invention provides a system and method for protecting buildings from damage due to seismic waves. The system comprises a bed of sand contained between two layers of polymer membrane, upon this sand bed a rests a first concrete slab, this first concrete slab supports, through a plurality of coil springs and shock absorbers, a second concrete slab. The structure to be protected is attached to the upward facing surface of the second concrete slab. In the event of an earthquake, the sand bed acts to slow the propagation of seismic waves, while the plurality of springs and shock absorbers isolates the structure from ground movements caused by the waves.

38 Claims, 5 Drawing Sheets

ANTI-SEISMIC SYSTEM

BACKGROUND OF THE INVENTION

1. Field of the Invention

The invention pertains to the field of vibration-damping. More particularly, the invention pertains to anti-seismic supports for protecting a structure from seismic shock.

2. Field of the Invention

The present invention was conceived by the inventor while observing his daughter and a friend jumping on a bed. The bed consisted of a box spring support and an inner-spring mattress. The bed remained stationary despite the series of shocks created by the jumping, and it was perceived that an analogous system could be constructed to protect buildings or skyscrapers against earth tremors. Thus inspired I sought a means for constructing buildings or towers that, irrespective of their height or weight, could resist earthquakes. After studying references related to springs and other constituents, the present invention was perfected.

During an earthquake energy is transmitted in the form of seismic waves. Two commonly known seismic waves are primary waves (P-waves) and secondary waves (S-waves). Primary waves are compression waves and typically travel at a speed of about 8 Km/sec. Secondary waves are transverse waves and typically travel at a speed of about 4 Km/sec.

SUMMARY OF THE INVENTION

The present invention provides a system and method of protecting buildings from damage due to seismic waves. The system comprises a bed of sand contained between two layers of polymer membrane, upon this sand bed rests a first concrete slab, the first concrete slab supports above it, through a plurality of springs and shock absorbers, a second concrete slab. The structure to be protected is attached to the upward facing surface of the second concrete slab. In the event of an earthquake, the sand bed acts to slow the propagation of seismic waves and dissipate some of their energy, while the plurality of springs and shock absorbers isolates the structure attached to the second concrete slab from ground movements caused by the waves.

DETAILED DESCRIPTION OF THE INVENTION

Figure 1:
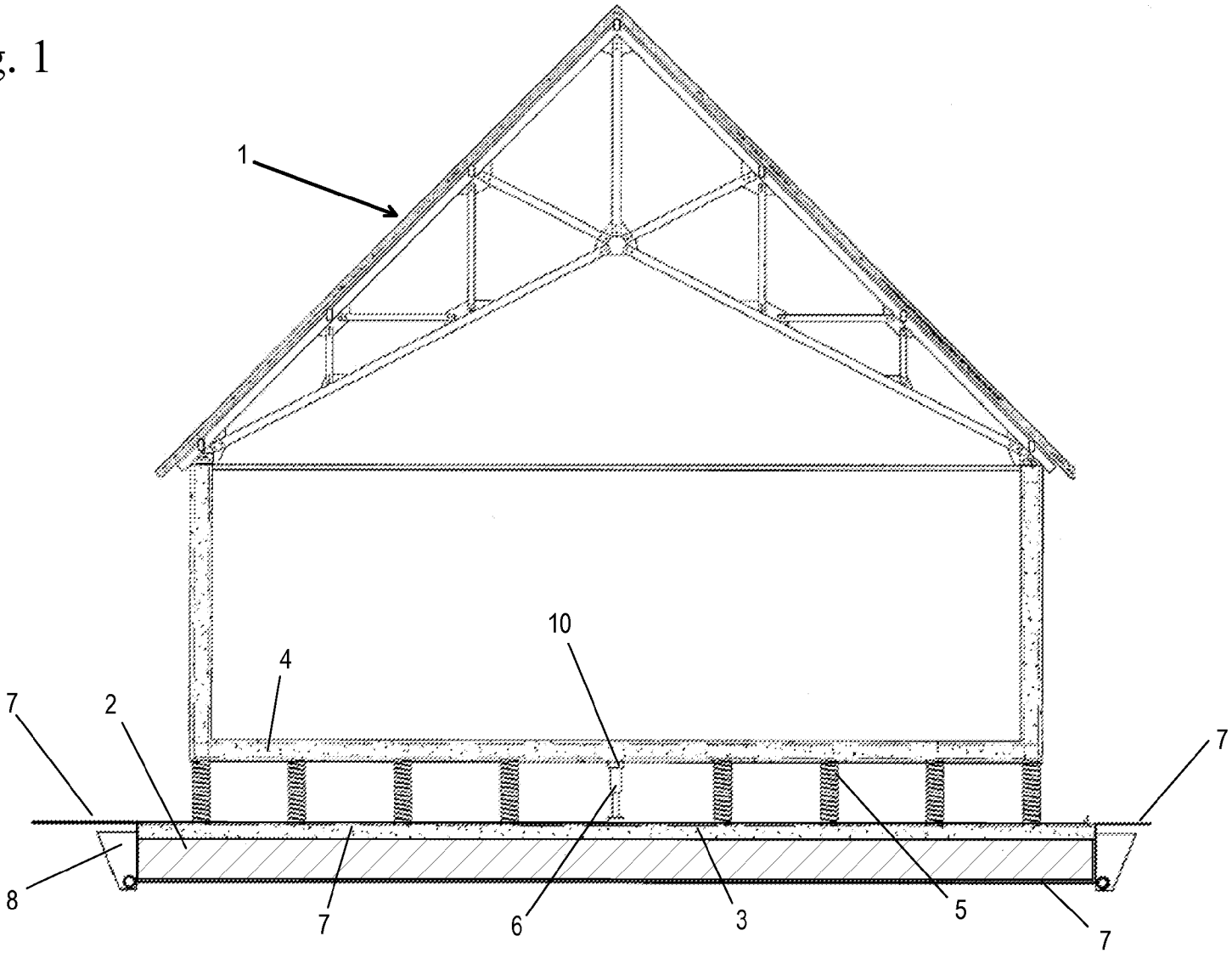
FIG. 1 shows a sectional view of a building supported by an anti-seismic system of the invention
Figure 2:
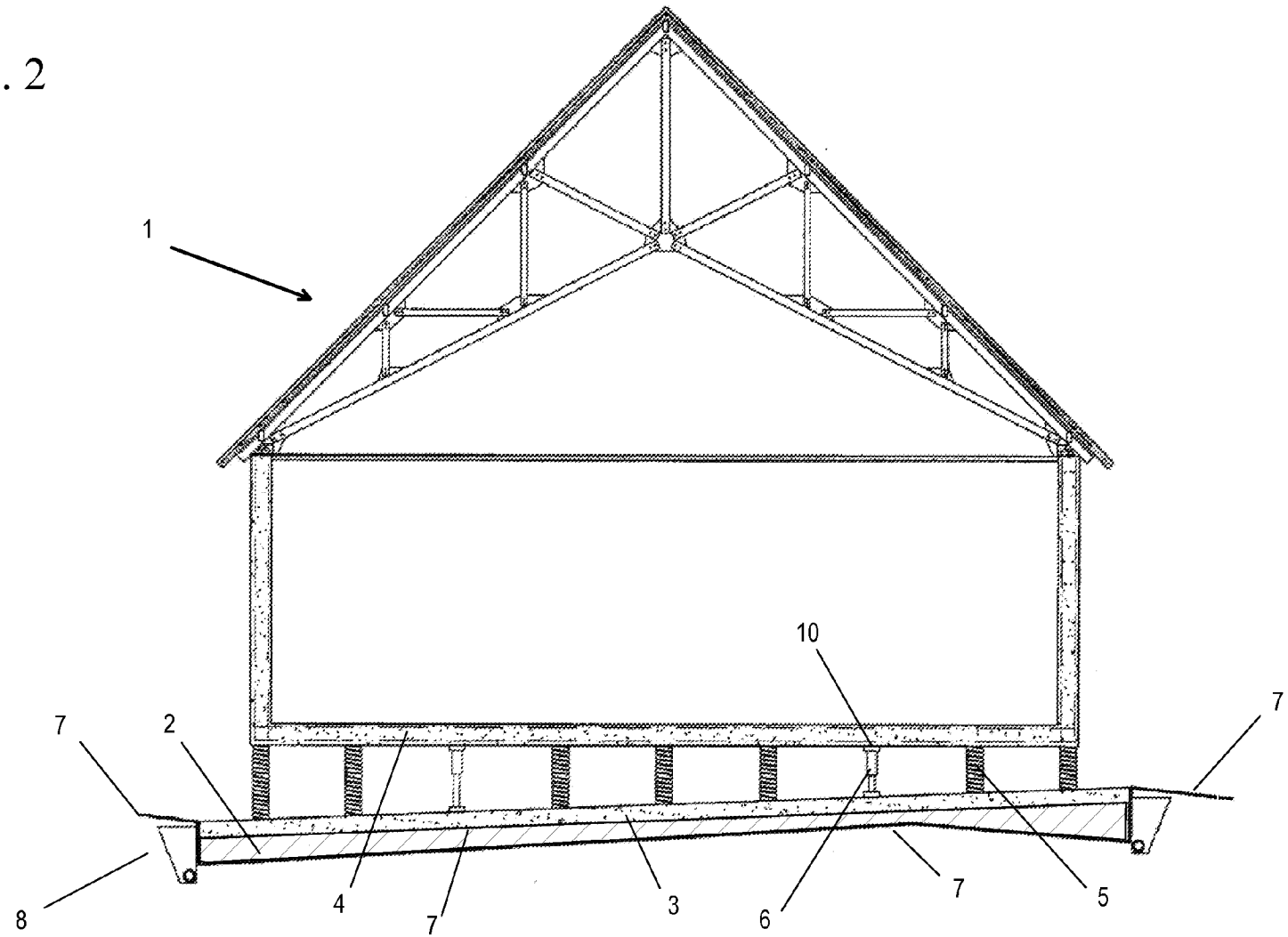
FIG. 2 shows a sectional view of the building of FIG. 1 reacting to ground movement.

FIGS. 1 and 2 illustrate a sectional view of a structure 1 supported by an anti-seismic system of the invention. The system comprises three major components, a sand bed 2, a pair of concrete slabs 3 and 4, and an array of springs 5 and shock absorbers 6 disposed between the two concrete slabs. FIG. 2 shows the system subjected to ground movement and illustrates deformation of the sand bed as well as the compression and extension of the springs and shock absorbers which act in concert to maintain the concrete slab 4 in a stable and substantially horizontal orientation.

1) The sand bed. A seismic wave that travels through granite at a speed of 4 Km/sec will be slowed to a speed of only 300 m/sec in sand. The lowermost component of the building support of the present invention consists of a sand bed 2 which lies between two sheets of impermeable plastic film 7. The plastic film 7 extends beyond the perimeter of the sand bed 2 to keep the surrounding soil from intermingling with the sand. In one preferred embodiment, the plastic film consists of polyane (a polyethylene film). The sand is preferably placed upon the first layer of film while damp and then overlaid with a second layer of film. Containing the damp sand between two impermeable polymer membranes maintains the moisture within the sand bed. In a preferred embodiment of the invention the sand bed has a uniform depth of about 40 cm. In a further embodiment, the sand bed is surrounded by a drain 8 at its perimeter.

2) The concrete slabs. Resting upon the plastic membrane at the top of the sand bed is a first concrete slab 3. The first concrete slab 3 supports a second concrete slab 4. The first and second concrete slabs are disposed with their faces parallel to each other separated by a gap which is bridged by an array of intervening springs and shock absorbers 5 and 6. The structure to be supported is attached to or built upon the upper surface of the upper concrete slab 4. The concrete slabs should be of a thickness and strength adequate to bear the weight of the structure to be supported. In a preferred embodiment the slabs are constructed of iron-reinforced concrete and are 10 cm thick.

Figure 4A:
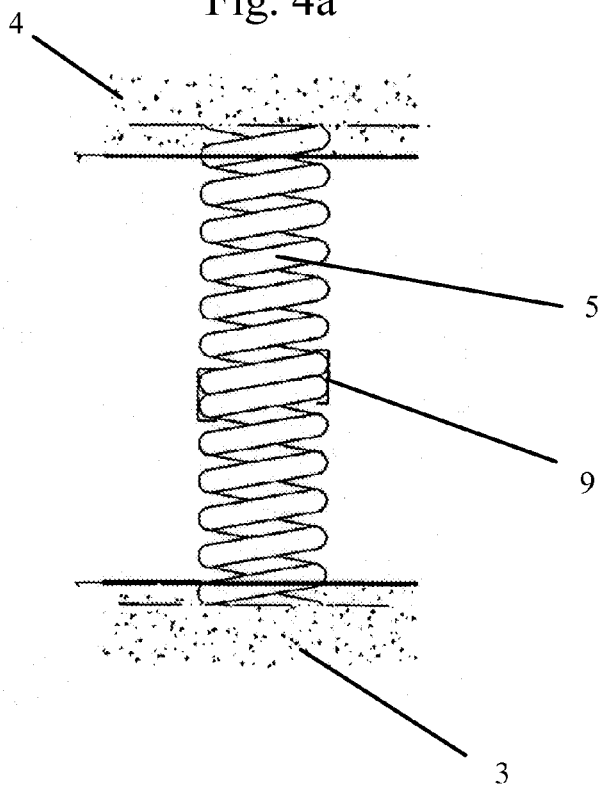
FIG. 4*a* shows a side view of a spring of the invention.
Figure 4B:
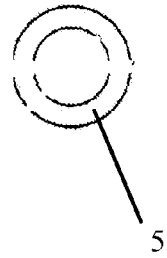
FIG. 4*b* shows an axial view of a spring of the invention.
Figure 4C:
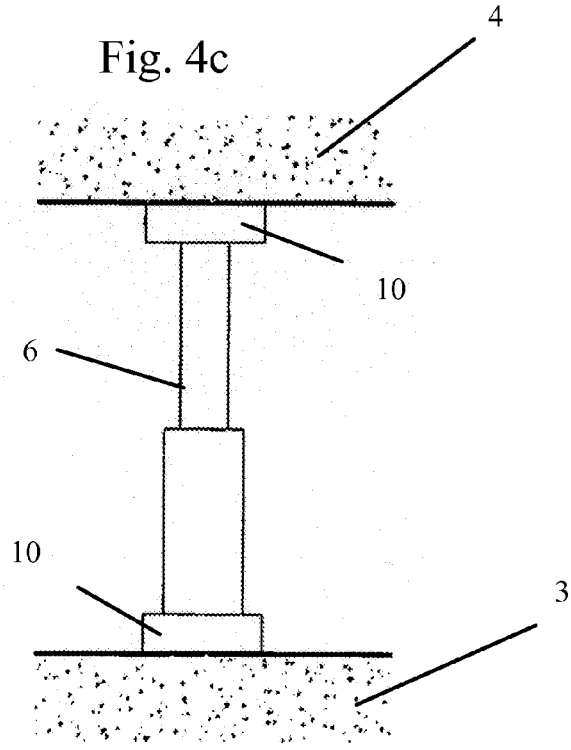
FIG. 4*c* shows a side view of a shock absorber and silent block of the invention.
Figure 4D:
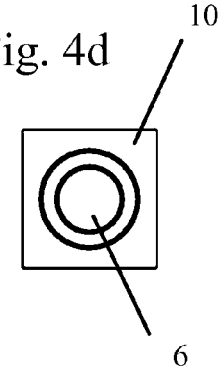
FIG. 4*d* shows an axial view of a shock absorber and silent block of the invention.

3) The array of springs and shock absorbers. The springs 5 must be of sufficient size, strength, and number to support the weight of the upper concrete slab as well as any structure to be supported thereon. FIGS. 4*a* and 4*b* illustrate a representative spring suitable for the invention. In a preferred embodiment the springs 5 are compression coil springs made from high strength steel such as maraging steel. Maraging steels with a tensile strength up to 3000 MPa may be employed in the present invention. A maraging steel particularly suitable for springs of the invention comprises 18% nickel and 1-2% beryllium. In a further preferred embodiment the maraging steel additionally comprises 0.5% bismuth. To adapt the invention for a particular application it is desirable to determine the strength and flexibility of individual springs. The springs employed must be designed to operate while supporting a certain weight. If they are either loaded with too much weight, or with not enough weight they are sluggish and may not perform properly. In designing the present invention, springs were studied for their ability to absorb shocks, twisting, compression and extension to endow the structure being supported with horizontal stability. Whatever movements the springs are subjected to they are designed to always resume their original shape. The dimensions of springs suitable for the invention were studied. The necessary values may be calculated using known formulae (1) and (2) to calculate the spring's flexibility f and maximum tolerable load $T_{max}$ respectively:

$$f = \frac{8nD^3}{Gd^4} \quad (1)$$

$$T_{max} = \frac{8DPk}{\pi d^3} \quad (2)$$

Where:

n=the number of spring coils

D=diameter of the spring, d=diameter of the spring wire,

P=load supported by the spring, k=form correction factor (ranges from 1.1 to 1.3)

G=shear modulus of the steel

The spring sizes suitable for a particular array may be derived by the following method:

a) calculating the maximum weight of the structure to be supported.

b) choosing the number of springs to be used in the array supporting the structure and dividing the weight of the structure by the number of springs to find the load per spring.

c) adding a determined safety factor to the load, and d) determining dimensions of suitable springs using formula (2) above inserting the load calculated in c) as the load P.

For reference, the springs used in a Boeing 747 are designed to resist 1200 MPa Springs found suitable for one preferred embodiment of the invention have an external diameter of 17 cm, an uncompressed height of 65 cm, and consist of 13 turns of wire with a 30 mm diameter.

It is advantageous that the springs 5 in the array be securely fixed to the concrete slabs 3 and 4. The springs may be attached by being physically set into the concrete slabs 3 and 4 as shown in FIG. 4*a*. In one preferred embodiment, the lower ends springs are set into the upper surface of the lower concrete slab 3 to a depth of 5 cm and the upper ends of the springs are set into the lower surface of the upper concrete slab 4 to a depth of 5 cm. In some cases it may be advantageous to provide clips 9 near the center of one or more of the springs of the array. The clips 9 constrain two or more turns near the center of the spring and are intended to prevent undue distortion of the springs during an earthquake.

Figure 3:
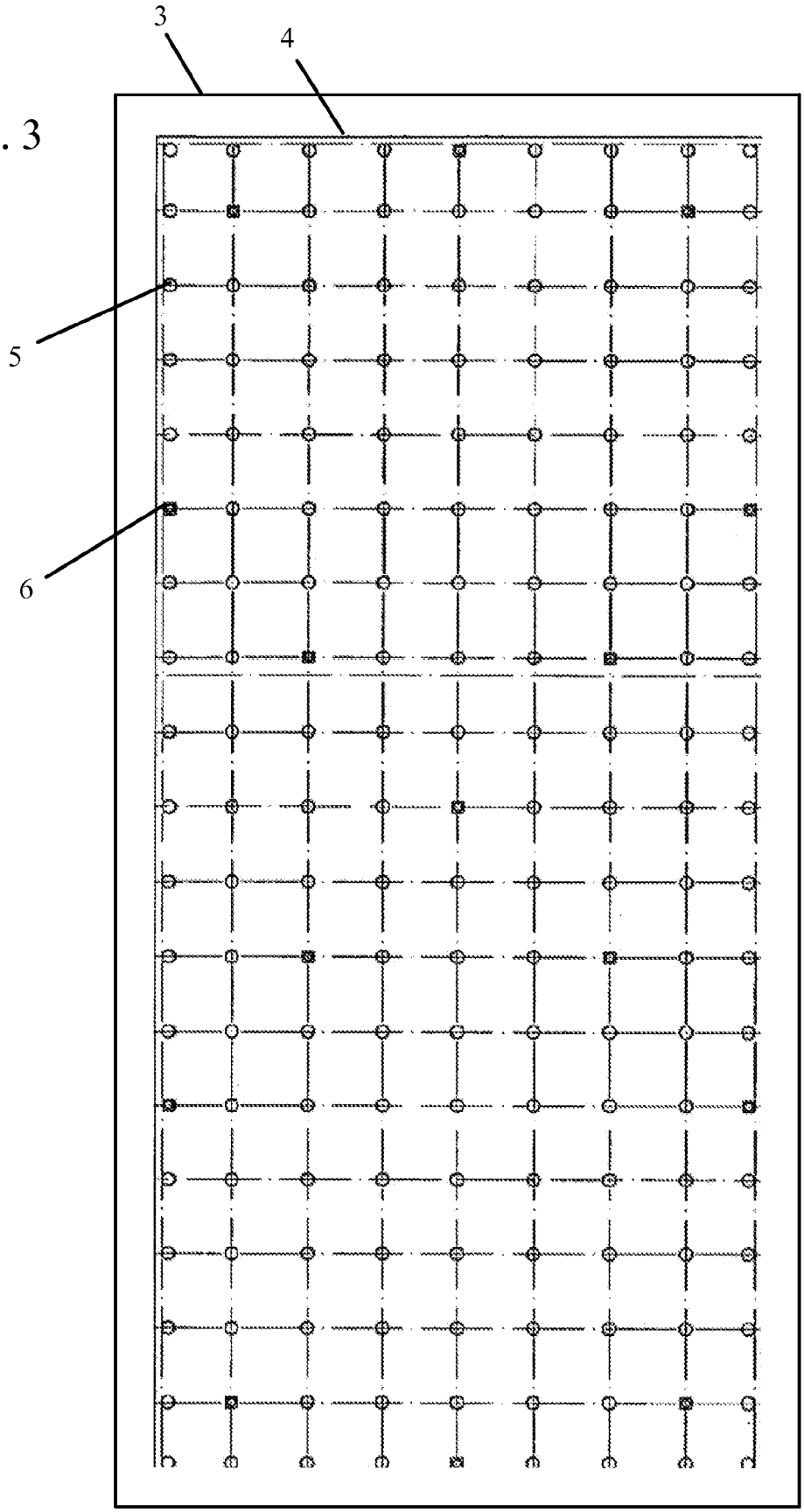
FIG. 3 shows a plan view of an array of springs and shock absorbers of the invention.

As illustrated in FIG. 3 a plurality of springs 5 make up the array which supports the second concrete slab 4. In one embodiment the springs 5 are placed in an array of regularly spaced rows and columns as shown. In a further preferred embodiment, the outermost rows and columns of springs are inset 60 cm from the edges of the lower concrete slab 3. In another preferred embodiment, the outermost rows and columns of springs are inset 10 cm from the edges of the upper concrete slab 4. The lower slab may be constructed to extend beyond the perimeter of the upper slab (for instance by 50 cm), such that both of the above embodiments may be employed together. In a further preferred embodiment the rows and columns of springs in the array are spaced 1 meter apart. It is to be understood that the springs 5 may be disposed in other geometric arrangements to form the array as long as they are collectively able to bear the weight of the structure as determined by the process outlined above.

Figure 7A:
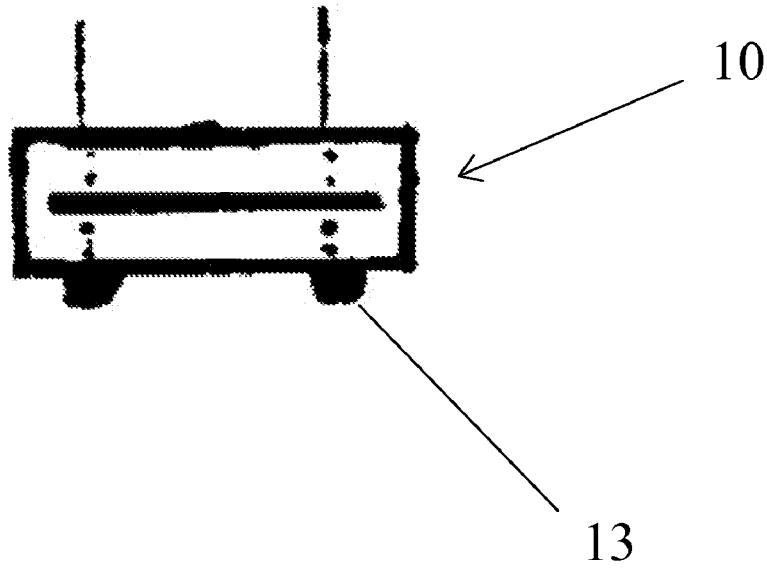
FIG. 7*a* shows a silent block of the invention.
Figure 7B:
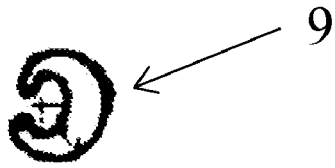
FIG. 7*b* shows a spring clip of the invention.

In addition to the springs 5, the array supporting the upper concrete slab 4 comprises a plurality of shock absorbers 6. When in their working position in array the shock absorbers 6 may be partially compressed. In one preferred embodiment the shock absorbers have an uncompressed length of 55 cm and are compressed to 50 cm when in their operating position in the array. The shock absorbers 6 may be mounted upon silent blocks 10 attached to the concrete slabs. In a preferred embodiment the shock absorbers are mounted on square silent blocks which are 5 cm thick, have 15 cm edges, and contain a plurality of through holes. The silent blocks 10 may be fixed to the concrete slabs 3 and 4 by bolts 13 (shown in FIG. 7*a*) passing through one or more of the holes into the concrete.

The shock absorbers 6 may be regularly interspersed among the columns of springs in the array as shown in FIG. 3. In one preferred embodiment the shock absorbers are triangulated in a pattern centered on the center of array since the weakest point is at the center of the construction. In a further preferred embodiment, a shock absorber is provided at the center point of at lease one edge of the array.

A representative embodiment of the spring and shock absorber array is illustrated in FIG. 3. Here the array of springs and shock absorbers comprises 156 springs and 15 shock absorbers in 9 rows and 19 columns spaced, and the shock absorbers are placed in: first, tenth and nineteenth columns, fifth row; second and eighteenth columns, second and eighth rows; sixth and fourteenth columns, first and ninth rows; and eighth and twelfth columns, third and seventh rows.

The present invention comprises a new approach to anti-seismic supports for structures. The invention provides a system that it is simple to construct, does not require significant modification of the structure to be supported, and requires little or no maintenance.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

The invention claimed is:

1. An anti-seismic support for protecting a structure from seismic shock comprising:

a) a first layer of plastic film;

b) a sand bed deposited on the layer of film to absorb shocks, trembling and land movement, and to slow down secondary waves and primary waves;

c) a second layer of plastic film on top of the sand bed to keep the sand bed moist; the first layer and second layer of plastic film being sized to extend beyond the sand on each side of the sand bed;

d) a first reinforced concrete slab cast over the second layer of plastic film;

e) a plurality of maraging steel springs and shock absorbers in an array of rows and columns across the first reinforced concrete slab; and f) a second concrete slab on top of the array of springs and shock absorbers; the structure to be protected being mounted on the second concrete slab.

2. The support of claim 1, in which the plastic film is polyane film.

3. The support of claim 1 in which the sand layer comprises a layer of non washed sand of 40 centimeter thickness.

4. The support of claim 1 in which the maraging steel springs comprise a mixture of 18% nickel and 1-2% beryllium with the steel.

5. The support of claim 4, in which the maraging steel springs further comprise 0.5% of bismuth.

6. The support of claim 1, further comprising the step of placing drainage outside the first layer of plastic film.

7. The support of claim 1, in which the thickness of the first concrete slab is 10 centimeters.

8. The support of claim 1, in which the outermost rows and columns of springs and shock absorbers are inset 60 centimeters from edges of the first concrete slab.

9. The support of claim 1, in which the outermost rows and columns of springs and shock absorbers are inset 10 centimeters from edges of the second concrete slab.

10. The support of claim 1, in which the springs are set into the first concrete slab approximately 5 centimeters.

11. The support of claim 1, in which the springs are set into the second concrete slab approximately 5 centimeters.

12. The support of claim 1 in which each of the plurality of springs has 13 turns and is 65 centimeters in length, with an exterior diameter of 17 centimeters, an interior diameter of 11 centimeters, and a wire cross-section diameter of 30 millimeters.

13. The support of claim 1, in which each of the plurality of shock absorbers is 55 centimeters in length, compressed to 50 centimeters between the two concrete slabs.

14. The support of claim 1, in which the shock absorbers are mounted upon silent blocks.

15. The support of claim 14, in which each of the silent blocks is a square of 15 centimeters, pierced by a plurality of holes.

16. The support of claim 15, in which the silent blocks are fastened to the concrete slabs by bolts set into the concrete while fluid, passing through the plurality of holes in the silent blocks.

17. The support of claim 14, in which the silent blocks are 5 centimeters in height.

18. The support of claim 1, in which the shock absorbers are triangulated in a pattern centered on the center of the array.

19. The support of claim 1, in which the shock absorbers are arranged at least on the center of each end column of the array.

20. The support of claim 1, in which the array of springs and shock absorbers comprises 156 springs and 15 shock absorbers in 9 rows and 19 columns, and the shock absorbers are placed in: first, tenth and nineteenth columns, fifth row; second and eighteenth columns, second and eighth rows; sixth and fourteenth columns, first and ninth rows; and eighth and twelfth columns, third and seventh rows.

21. The support of claim 1, in which the rows and columns of the array of springs and shock absorbers are arranged on one-meter spacing.

22. The support of claim 1, in which at least some of the springs have a clip constraining a plurality of middle turns, to avoid distortion during earthquakes or shock.

23. The support of claim 1, in which the structure is a building.

24. The support of claim 1, in which the structure is a bridge.

25. A method of constructing an anti-seismic support for a building, comprising the steps of:

a) preparing the land on which the structure is to be built;

b) placing a first layer of plastic film on the cleared land;

c) depositing a sand bed on the layer of film to absorb shocks, trembling and land movement, and to slow down secondary waves and primary waves;

d) placing a second layer of plastic film on top of the sand bed to keep the sand bed moist; the first layer and second layer of plastic film being sized to extend beyond the sand bed on each side of the sand bed;

e) casting a first reinforced concrete slab cast over the second layer of plastic film;

f) placing a plurality of maraging steel springs and shock absorbers in an array of rows and columns across the first reinforced concrete slab;

g) placing a second concrete slab on top of the array of springs and shock absorbers; and h) mounting the structure to be protected on the second concrete slab.

26. The method of claim 25, in which the plastic film is polyane film.

27. The method of claim 25 in which the maraging steel springs comprise a mixture of 18% nickel and 1-2% beryllium with the steel.

28. The method of claim 27, in which the maraging steel springs further comprise 0.5% of bismuth.

29. The method of claim 25, further comprising the step of placing drainage outside the first layer of plastic film.

30. The method of claim 25, in which the outermost rows and columns of springs and shock absorbers are inset from edges of the first concrete slab and the second concrete slab.

31. The method of claim 25, in which the springs are set into the first concrete slab and the second concrete slab.

32. The method of claim 25 further comprising the step, before step (f) of calculating required dimensions of the springs from a maximum weight of the structure by a method comprising the steps of:

i) dividing the weight of the structure by the number of springs in the array giving a load to be supported by each spring;

ii) adding a determined safety factor to the load;

iii) calculating the dimensions from the formula: Max-Load=8 DPk/pi*$d^3$ where D is a diameter of the spring, d is a diameter of wire in the spring, P is the load to be supported by the spring, k is a correction factor of form.

33. The method of claim 25, in which the shock absorbers are mounted upon silent blocks.

34. The method of claim 33, further comprising the step of fastening the silent blocks to the concrete slabs by bolts set into the concrete while fluid, passing a plurality of holes in the silent blocks.

35. The method of claim 25, in which the shock absorbers are triangulated in a pattern centered on the center of the array.

36. The method of claim 25, in which the shock absorbers are arranged at least on the center of each end column of the array.

37. The method of claim 25, in which the array of springs and shock absorbers comprises 156 springs and 15 shock absorbers in 9 rows and 19 columns, and the shock absorbers are placed in: first, tenth and nineteenth columns, fifth row; second and eighteenth columns, second and eighth rows; sixth and fourteenth columns, first and ninth rows; and eighth and twelfth columns, third and seventh rows.

38. The method of claim 25, in which at least some of the springs have a clip constraining a plurality of middle turns, to avoid distortion during earthquakes or shock.

* * * * *